US005444434A

United States Patent [19]

Serby

[11] Patent Number: 5,444,434

[45] Date of Patent: Aug. 22, 1995

[54] EXTENDED LIFE SMOKE DETECTOR

[76] Inventor: Victor M. Serby, 255 Hewlett Neck Rd., Woodmere, N.Y. 11232

[21] Appl. No.: 899,622

[22] Filed: Jun. 15, 1992

[51] Int. Cl.[6] ..... G08B 21/00

[52] U.S. Cl. ..... 340/628; 340/636; 320/48

[58] Field of Search ..... 340/628, 636, 629, 630; 320/48, 3; 324/425, 427, 433, 434; 429/122

[56] References Cited

U.S. PATENT DOCUMENTS 4,231,026 10/1980 Sullivan ..... 340/636
5,115,223 5/1992 Moody ..... 340/573

OTHER PUBLICATIONS

"Kodak and Dicon Systems Team Up to Promote new Long-Life Lithium Batteries and Smoke Detectors", New Release Dec. 1988.

"Extended-Life Non-Removable Battery for Smoke Detectors", 1991.

*Primary Examiner*—Jeffery A. Hofsass
*Attorney, Agent, or Firm*—Victor M. Serby

[57] ABSTRACT

The present invention is an improvement in battery powered smoke detectors. A smoke detector is powered by a series connection of two $Li/SOCl_2$ cells having a capacity of about 2 amp hours. The smoke detector draws a quiescent current of about 7 μA. A low voltage alarm activates when the battery voltage falls below about 6.0 volts upon the periodic application of about a 250 μA to about a 1 mA battery test pulse. The cells are soldered directly into the smoke detector PC board and the smoke detector is placed in an unopenable case to deter battery removal. Smoke detector life expectancy including the battery is 15 years.

10 Claims, 3 Drawing Sheets

EXTENDED LIFE SMOKE DETECTOR

This invention was made with Government support under grant number SOH (AHR-B) 1 R43 CE00014-01 awarded by the Centers for Disease Control (CDC), Center for Environmental Health and Injury Control (CEHIC), Division of Injury Control. The Government has certain rights in this invention.

BACKGROUND OF THE INVENTION

This invention is concerned with battery powered smoke detectors, particularly a smoke detector and power source, together, having an operational life greater than 10 years.

It is a proven fact that operating smoke detectors give the early warning needed to save lives in dwelling fires. The importance of this fact is widely recognized and most jurisdictions now require landlords to provide working smoke detectors for each apartment. Also, in many states, such as New York State, a seller of a house must file an affidavit that the house has a working smoke detector before title can transfer. However, conventional smoke detectors use carbon-zinc chemistry batteries which last only one year in the application and are often removed to silence the low battery alarm and never replaced. Also, since the battery is removable (due to requirements for periodic replacement) and interchangeable in other equipment, the smoke detector battery is often "borrowed" and never replaced. Smoke detector batteries are also often removed to silence the din from false alarms caused by kitchen smoke, and left disconnected or inserted backwards to defeat the operation of visual battery removal indicators. These practices and similar scenarios often end in tragedy when a fire occurs and no smoke detector protection is afforded because the battery is either missing or disconnected.

In October 1985, Underwriters Laboratories (UL) issued the third edition of UL 217 titled "Standard for Safety Single and Multiple Station Smoke Detectors" which makes no mention of the problem of removed batteries. But UL eventually recognized the problem of removed batteries and in Jul. 17, 1987, issued revised UL 217 which took effect Feb. 28, 1989. Sections 6B.1 and 6B.2. requiring visual battery removal indicators in all battery powered smoke detectors were added. Visual battery removal indicators helped solve the problem, but only in a minor way because they are only meant as warnings and are not a foolproof means of preventing battery removal. According to the International Association of Fire Chiefs, currently 85% of American homes have at least one smoke detector, but one-third have dead or missing batteries.

Recent attempts to solve the problem of dead or missing smoke detector batteries have focused on public education. For example, the New York Times ran an editorial on Oct. 27, 1991 urging people to coordinate their smoke detector battery changes with the switch from daylight savings to standard time, and public service radio advertisements by local fire departments and insurance companies urge everyone to check his smoke detector batteries.

Omnibus Solicitation of the Public Health Service for Small Business Innovation Research (SBIR) Grant Applications (91-2) requests proposals to "design and develop an extended-life, non-removable power source for smoke detectors" as one of The Center for Environmental Health and Injury Control's (CEHIC) research topics. The CEHIC recognized the fact that a non-removable extended life power source for smoke detectors is the only way to ensure continued smoke detector protection. Unfortunately, previous attempts to make an extended life battery for a smoke detector have failed. Merely increasing the capacity of carbon-zinc or zinc-alkaline chemistry batteries does not appreciably increase battery life in a smoke detector application due to the high self discharge rate (compared with the desired operation time) of these cell chemistries. A smoke detector having a battery with an operating life of at least 10 years was CEHIC's desired goal.

SUMMARY OF INVENTION

The primary purpose of the invention is to avoid the safety problems associated with one year batteries stated supra. A secondary purpose is to end the inconvenience of one having to frequently change smoke detector batteries.

The invention is a form, fit and function improvement of a battery powered smoke detector having a smoke detector integrated circuit, the smoke detector having a low battery alarm which sounds when the battery voltage is less than a threshold voltage, the improvement giving the smoke detector a useful life of over 15 years on the originally supplied battery.

The improvement in its basic form comprises a lithium anode primary cell or a series connection of lithium anode primary cells to power the smoke detector. The low battery alarm voltage threshold set-point and the magnitude of the battery test current pulse is adjusted to optimize battery capacity utilization. The improvement is also a new use of lithium anode primary cells to power smoke detectors.

Smoke detector battery life of 15 years or more is achievable. This allows the complete smoke detector to be housed in an unopenable case to deter battery removal. The suggested replacement date may be placed on a visible external surface at which time the whole smoke detector unit should be replaced. Of course the low battery alarm will still be active and signal when the unit must be replaced should someone forget to replace the unit at the specified date.

DESCRIPTION OF PREFERRED EMBODIMENT

To avoid confusion, the term "battery" when used herein refers to a connection of two or more electrochemical cells or a single electrochemical cell.

Figure 1:
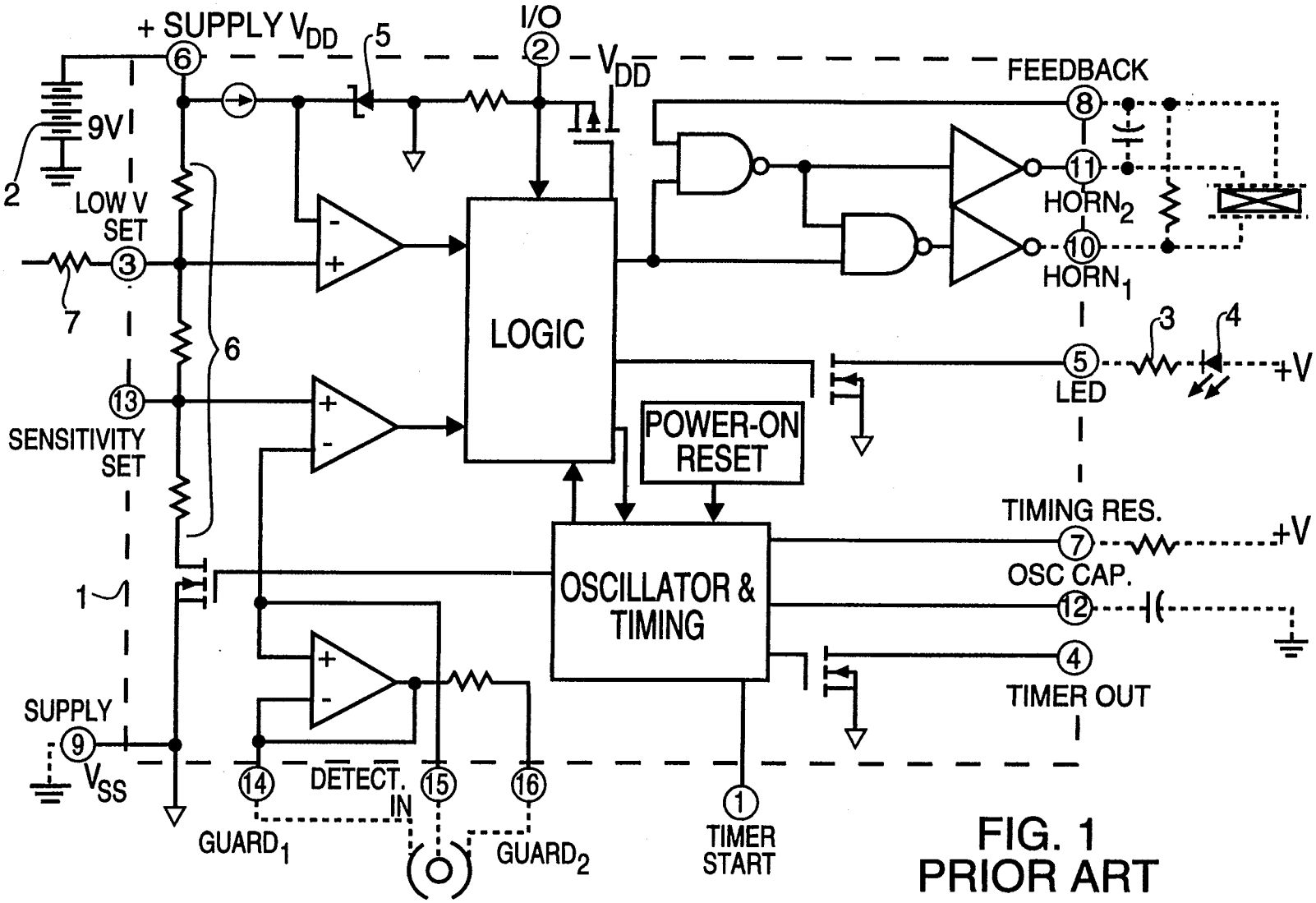
FIG. 1 PRIOR ART
FIG. 1 is a functional block diagram/schematic of a smoke detector.

FIG. 1 shows is a typical functional block diagram/-schematic of a battery powered smoke detector. In a typical prior art smoke detector, the smoke detector integrated circuit (IC) (1), such as the Allegro 5348 or similar IC is powered from a battery (2) which is a 9 volt carbon zinc or zinc alkaline chemistry battery. The smoke detector contains a means for applying a periodic pulse current to battery (2) through pin 5. Resistor (3) and LED (4) determine the magnitude of the battery test pulse current which is periodically applied to battery (2). This battery test pulse current is about 10 mA for the Eveready 216 and similar 9 volt batteries. The smoke detector also contains a means for triggering an alarm when the battery voltage falls below a threshold voltage. The threshold voltage at which the low battery alarm is activated is determined by zener diode (5) and voltage divider (6) (both internal to IC (1)), and resistor (7) from pin 3 to either $V_{DD}$ or $V_{SS}$ to externally adjust the low battery alarm threshold voltage. Without any external adjustment, prior art smoke detector IC's low battery alarm threshold voltages are set at about 7.5 volts. Most prior art smoke detector IC's allow adjustment no lower than about 7.0 volts, and a few allow reliable adjustment down to about 6.4 volts. The smoke detector further contains means for triggering an alarm in response to concentration of smoke above a threshold value.

Figure 2:
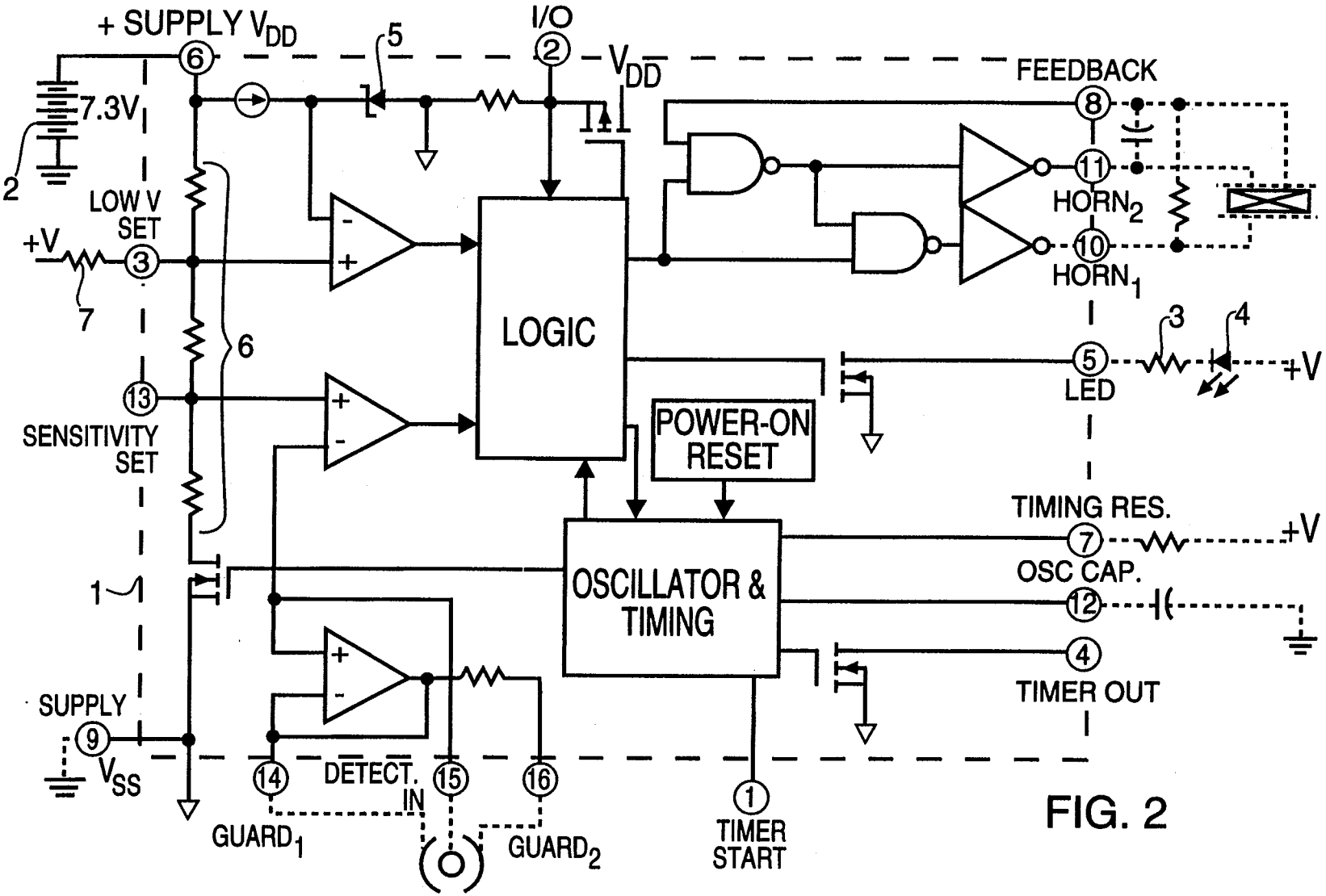
FIG. 2 is a functional block diagram/schematic of an improved smoke detector using lithium/thionyl chloride cells as the power source.

In accordance with a first preferred embodiment of the invention, FIG. 2 is a typical functional block/-schematic diagram of a smoke detector which will have a useful life of about 15 years. Circuit topology is similar to prior art smoke detectors, however the type of battery powering the smoke detector, the magnitude of the periodic battery test pulse current and the magnitude of the low battery alarm threshold voltage is different and the components affecting these magnitudes are different in value. A smoke detector integrated circuit (IC) (1) such as the Allegro 5348 or similar IC is powered from a battery comprised from a series connection of two AA size $Li/SOCl_2$ primary cells (2), having a rated capacity of about 2 AH and a nominal voltage of 3.65 volts per cell. Tadiran part number TL-5903 (2.4 AH) and Saft part number LS-6 (1.8 AH) are representative of the types of lithium anode primary cells which work well in this application. Smoke detectors based on this or a similar CMOS IC can be designed to have a quiescent current of about 7 $\mu$A or less when powered from voltage sources of about 9 volts or less. Superimposed on top of this 7 $\mu$A quiescent current is a periodic battery test pulse current having a preferred pulsewidth of about 10 ms and a preferred amplitude of about 250 $\mu$A to 1 mA. The amplitude of this test pulse current is controlled by resistor (3) and LED (4). Resistor (3) has a value of about 6 Kohms to give about a 1 mA battery test pulse current. This battery test pulse current has a repetition period of about 40 seconds. The battery test pulse current may be further reduced or eliminated altogether if a visual periodic LED indication of unit operation is not required. The low voltage alarm threshold is preferably set at about 5.6 to 6.4 volts (2.8 to 3.2 volts per $Li/SOCl_2$ cell in series) which gives the battery a useful life of at least 15 years in this application. In a smoke detector based on the Allegro 5348, a 6.4 volt low battery alarm threshold voltage was achieved by using a 9.1 Kohm resistor (7) between pin 3 and $V_{DD}$. This is the lowest value of low battery voltage alarm threshold that can be reliably set in this IC. Using a battery (2) comprising a series connection of two larger capacity cells such as C size (about 5.2 AH) will permit continuous operation for longer than 25 years.

It should be noted that the lowest value of low voltage threshold that can be set in a currently commercially available smoke detector IC is about 6.3 volts. Most prior art smoke detector ICs will not allow adjustment of the low voltage threshold below about 7.0 volts. Most have low voltage threshold set points of about 7.5 volts in the absence of external trim resistors. It is therefore preferred when using a series connection of two $Li/SOCl_2$ cells to power the smoke detector to use a custom made smoke detector IC having a low voltage threshold set point of about 6.0 volts in the absence of external resistors, with full adjustment capability in at least the range of about 5.6 to about 6.6 volts. Those skilled in the art of integrated circuit design can easily provide such an IC.

The low battery test pulse current must be minimized so that the LiCl passivation layer in the $Li/SOCl_2$ cell is not destroyed. Otherwise, the self discharge rate of the cells becomes excessive and battery longevity is reduced. Furthermore, large low battery test pulse currents directly consume significant battery life. In a typical AA cell having about 14 square centimeters of anode area, the low battery test pulse current should be under about 5 mA and preferably under about 1 mA to prevent excessive self discharge. In cells having the same chemistry, the magnitude of the low battery test pulse current should be proportional to the anode area of the cell to maintain the same anode current density. Larger capacity cells having larger anode areas such as a C size will require proportionally more test pulse current with respect to anode area to have the same voltage drop characteristics.

Another reason for having low magnitude battery test pulse currents is that the passivation layer acts as a resistor in series with the cell, thereby dropping voltage when the pulse occurs. This voltage drop for a 1 mA 10 ms pulse with a pulse repetition frequency of about 40 seconds on a background current of about 7 $\mu$A will build to a steady state value of about 0.14 volts in a typical AA size $Li/SOCl_2$ cell having 10 to 14 square cm of anode area. Ideally, selection of the battery test pulse current and the low battery threshold voltage must be made so that the low battery alarm is sounded when about 1 to 2 months worth of energy or as close thereto as practical (erring on the high side) is remaining in the battery. The remaining energy includes at least 7 days of low battery alarm operation as required by specification UL 217. Because, $Li/SOCl_2$ chemistry cells at the discharge rates of interest have a steep drop in end life voltage as a function of remaining capacity, to meet this criterion it is preferred to set the low battery alarm threshold voltage at about 3.0 volts per cell in series and have the battery test pulse current set at about 1 mA. This will trigger the low battery alarm when the battery voltage under quiescent current draw is about 3.1 volts per cell in series. However, substitution of other combinations of low battery alarm threshold voltage and battery test pulse current magnitude will perform essentially the same function in essentially the same way to achieve essentially the same result as the preferred combination. Particularly, many combinations of battery test pulse currents from zero to about 5 mA and low battery alarm threshold voltages in the range of about 2.8 to about 3.5 volts per cell in series will perform adequately for typical AA size bobbin cells although many of these combinations fall outside of the most preferred range.

Micro-calorimetric measurements of lithium anode chemistry cells permit relatively quick quantification of the self-discharge rate of the cells under various load conditions. This enables accurate prediction of the longevity of a particular battery in smoke detector applications. In addition, the maximum magnitude of the battery test pulse current to prevent excessive self discharge can be determined by this method.

One is cautioned against merely substituting a lithium anode primary battery into the smoke detector of FIG. 1 which is designed to operate on 9 volt carbon/zinc or $Zn/MnO_2$ chemistry batteries as one may be tempted to do. Such action will result in a poorly operative smoke detector which will not achieve a significant increase in battery life. The long battery life in the smoke detector will not be achieved unless the aforementioned smoke detector electrical characteristics are matched to the lithium anode battery.

Figure 3:
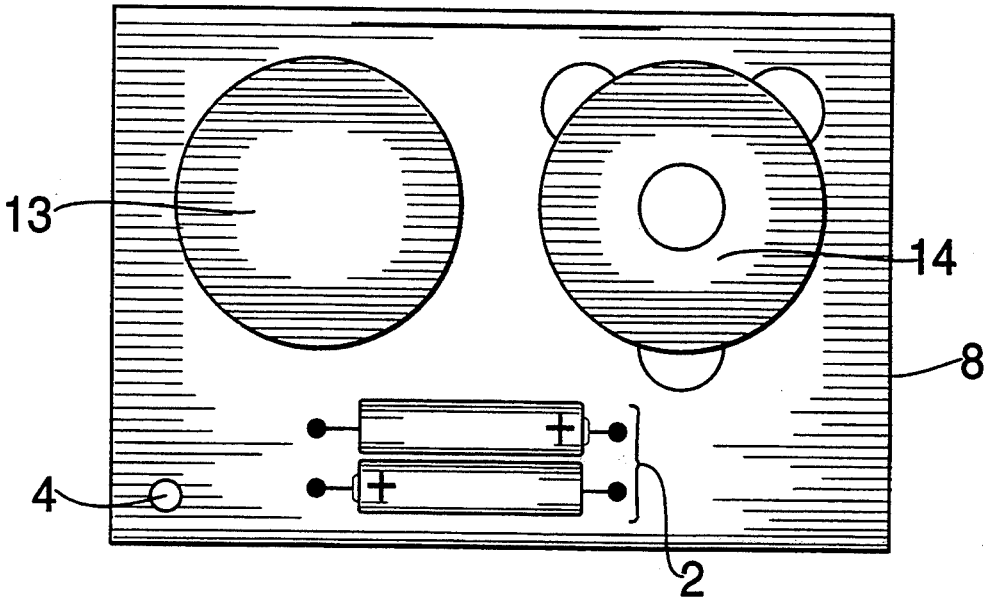
FIG. 3 is a layout diagram of a circuit board of the improved smoke detector.
Figure 4:
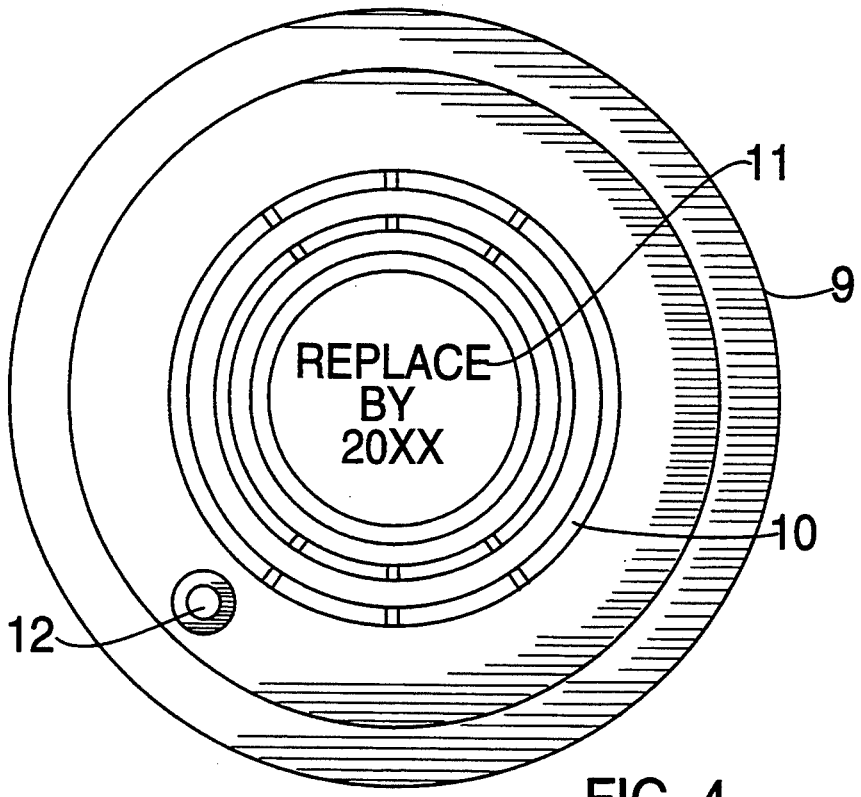
FIG. 4 is a view of the improved smoke detector in a case.

Referring to FIG. 3, it is preferred to permanently solder the $Li/SOCl_2$ battery (2) into the smoke detector printed circuit (PC) board (8) for ease of assembly and to deter removal of the battery. IC (1) is soldered to PC board (8) under smoke detecting means comprising smoke chamber (13), and most of the rest of the electronic components are soldered into PC board (8) under piezoelectric horn (14) as is customary in the art. LED (4) is positioned, as customary in the art, with an unblocked view so that it may be observed during smoke detector operation. Unlike prior art smoke detectors in which the batteries are intended to be consumer removable and replaceable, the factory installation of a lithium anode primary battery is intended to be permanent for the life of the smoke detector. Referring to FIG. 4, it is also preferred to place the assembled smoke detector circuitry inside an unopenable case (9), which prevents physical access, to further deter battery removal or tampering. An injection molded plastic two piece snap-together case, which will not come apart once snapped together is envisioned for this application. The case has small openings (10) communicating between the inside and outside to allow the entrance of smoke and the unmuffled exit of sound from an audible alarm internal to the case. It is preferred to place a suggested replacement (11) date on a visible external surface of the case (9). Test button (12) is of prior art design and communicates light from LED (4) to the outside of case (9). Pressing button (12) activates the alarm. "Set and forget" operation is anticipated for at least 15 years at which point the complete unit would be discarded and replaced with another at the suggested replacement date or when the low battery alarm activates. Since the smoke detector is a form, fit and function replacement for prior art battery powered smoke detectors, smoke detector placement and all operational parameters other than those affecting battery replacement would be the same as currently recommended in the literature for battery powered smoke detectors. The brief pressing of test button (12) however, is preferred to be on a bi-monthly basis rather than on a weekly basis as recommended for prior art smoke detectors. Should smoke be detected, the LiCl passivation layer automatically breaks down upon higher current draw and the horn will be driven at an acceptable volume of at least 85 db. All the applicable performance requirements of UL specification 217 can be met by using the invention.

Although a fairly wide operating temperature range is possible, it is preferred to use this invention at the normal fluctuations of residential room ambient temperature (about 17 to 30 degrees Celsius). In this temperature range, it is preferable to set the battery test pulse current at about 500 $\mu$A to 1 mA for AA size $Li/SOCl_2$ cells. If the temperature range is increased to include lower temperature operation down to about 10 degrees Celsius, it is preferable to set the battery test pulse current at about 250 $\mu$A to 500 $\mu$A. It is advisable not to exceed about 37 degrees Celsius for extended periods because battery life will be significantly reduced and 15 year operation will not be achieved. Very low temperature operation may trigger the low battery alarm even though significant energy remains in the battery. In this case though, the battery will automatically recover when the temperature is again increased.

Other embodiments exist where different lithium anode chemistry cells such as $Li/(CF)_n$ power the smoke detector. However, these other lithium anode chemistries either do not have as good a volumetric energy density as $Li/SOCl_2$ nor as high an operating voltage, and are therefore considered secondary preferred embodiments to $Li/SOCl_2$ cells. For example, a series connection of three $Li/(CF)_n$ A size cells are needed with a low voltage alarm threshold of about 7.5 volts (2.5 volts per cell in series) and a battery test pulse current of about 250 $\mu$A to 1 mA to meet a 15 year life.

Increasing the useful life of a smoke detector battery presents another problem which must be considered. The longevity of the battery may exceed the useful life of the smoke detector electronics. UL 217 lists in section S3.1, the maximum allowable failure rates of smoke detectors based on MIL-HDBK-217B methods of calculation and other reliability prediction methods. The current maximum allowable failure rate ranges from 3.5 to 4.0 failures per million hours depending on the reliability prediction method employed. Based on the "parts stress analysis" method of MIL-HDBK-217F using the ground benign environment at a 25 degree Celsius ambient temperature for a 15 year smoke detector battery, it is preferred to have a maximum smoke detector electronics failure rate of 0.38 per million hours, and for a 25 year smoke detector battery it is preferred to have a maximum failure rate of 0.23 per million hours. The smoke detector IC must also be checked to make sure that the calculated point where 5% of the part population could be expected to experience wear-out ($t_{5\%}$) for electromigration and time dependent dielectric breakdown, as applicable, is not within the expected smoke detector lifetime.

Although a specific preferred embodiment of the present invention has been described in detail above, it is readily apparent that those skilled in the art and science may make various modifications and changes to the present invention without departing from the spirit and scope thereof. These changes include but are not limited to substitution of equivalents, addition of elements, or incorporation of the invention as a feature of other equipment. It is to be expressly understood that this invention is limited by the following claims:

What is claimed is:

1. A smoke detector of the type powered by a battery, said smoke detector having means for triggering an alarm in response to a concentration of smoke above a threshold value, said smoke detector having means for triggering an alarm when the battery voltage falls below a threshold voltage, said battery having a service life within said smoke detector of at least one year, wherein the improvement comprises:

a) a lithium anode primary battery powering said smoke detector; and b) means for providing a periodic pulse current to said battery, the magnitude of said pulse current falling within the range of zero to about 11 mA.

2. The smoke detector of claim 1 wherein said lithium anode primary battery comprises a lithium/thionyl chloride cell or a series connection of lithium thionyl chloride cells powering said smoke detector.

3. The smoke detector of claim 2 wherein said threshold voltage is about 2.8 to about 3.5 volts per cell in series.

4. The smoke detector of claim 3, wherein the magnitude of said pulse current is in the range of zero to about three milliamps per 14 square centimeters of each cell's anode area.

5. The smoke detector of claim 1 further comprising a case, said case having an inside and an outside, said case having openings therein communicating between said inside and said outside to allow the entry of smoke from said outside to said inside, said electronic circuit and said battery contained within said case, said battery having a service life within said smoke detector of at least ten years, said case unopenable to deter physical access to said battery.

6. A smoke detector comprising:

(a) an electronic circuit, said electronic circuit having means for triggering an alarm in response to a concentration of smoke above a threshold value, said electronic circuit having means for triggering an alarm in response to its supply voltage falling below a threshold voltage, said threshold voltage having a range of about 7.0 volts to about 5.6 volts; and (b) a battery, said battery providing said supply voltage to said electronic circuit, said battery comprising a series connection of two $Li/SOCl_2$ primary cells, said battery having a capacity of about 2 amp hours; and (c) means for providing a periodic pulse current to said battery, the magnitude of said pulse current falling within the range of zero to about 5 mA.

7. The smoke detector of claim 6 wherein the magnitude of said pulse current falls within the range of about 250 μA to about 3 mA.

8. The smoke detector of claim 7 wherein the magnitude of said pulse current falls within the range of about 250 μA to about 1 mA.

9. The smoke detector of claim 8 wherein said threshold voltage is about 6.2 volts.

10. The smoke detector of claim 6 further comprising a case and smoke detection means, said case having an inside and an outside, said case having openings therein communicating between said inside and said outside to allow the entry of smoke from said outside to said inside, said electronic circuit and said battery and said smoke detection means contained within said case, said battery having a service life within said smoke detector of at least ten years, said case unopenable to deter physical access to said battery.

* * * * *